US005992072A

United States Patent [19]

Garfinkle

[11] Patent Number: 5,992,072

[45] **Date of Patent: *Nov. 30, 1999**

[54] SHELF EXTENDER

[76] Inventor: Benjamin L. Garfinkle, 1120 Portal Ave., Piedmont, Calif. 94610

[ * ] Notice: Under 35 U.S.C. 154(b), the term of this patent shall be extended for 357 days.

[21] Appl. No.: 08/797,496

[22] Filed: Feb. 7, 1997

Related U.S. Application Data

[63] Continuation of application No. 08/462,953, Jun. 5, 1995, abandoned.

[51] Int. Cl.[6] ..... G09F 3/18

[52] U.S. Cl. ..... 40/642.02; 40/661.03

[58] Field of Search ..... 40/642.01, 642.02, 40/649, 657, 661.03, 663; 248/298; 211/184; 108/65, 69, 90

[56] References Cited

U.S. PATENT DOCUMENTS

| | | | |
|---|---|---|---|
| 4,140,224 | 2/1979 | Celeste | 40/661.03 X |
| 4,606,280 | 8/1986 | Poulton et al. | 108/97 |
| 4,669,208 | 6/1987 | Stoddard | 40/642 X |
| 4,713,899 | 12/1987 | Fast | 40/642 |
| 5,199,199 | 4/1993 | Garfinkle | 40/5 |
| 5,201,487 | 4/1993 | Epplett | 248/298 |
| 5,295,596 | 3/1994 | Squitieri | 211/184 X |
| 5,394,632 | 3/1995 | Gebka et al. | 40/661.03 |
| 5,402,897 | 4/1995 | Garfinkle | 40/642 X |
| 5,419,066 | 5/1995 | Harnois et al. | 40/649 X |

*Primary Examiner*—Brian K. Green
*Attorney, Agent, or Firm*—Malcolm B. Wittenberg

[57] ABSTRACT

A shelf extender for attachment to a perf-board shelf having a regular array of holes configured therein. Slots are configured within the top surface of the shelf extender for receiving plastic rivets or other suitable attachment expedience which are caused to pass through the slots and within the holes contained within the supported shelf for slidable attachment of the shelf extender thereto.

5 Claims, 2 Drawing Sheets

SHELF EXTENDER

This is a continuation of application Ser. No. 08/462.953 filed on Jun. 5, 1995, now abandoned.

TECHNICAL FIELD OF THE INVENTION

The present invention relates to a detachable shelf extender for extending forward from the leading edge of a display shelf generally found in supermarkets and similar environments.

BACKGROUND OF THE INVENTION

Supermarket display shelves are oftentimes crowded with a multitude of consumer products, each of which vies for customer attention. As such, it has been found that shelf extenders are a useful merchandising tool which can not only highlight a particular product on a crowded shelf but also assist the market owner in providing additional shelf space for housing product inventories.

Shelf extenders are generally provided for extending from the forward edge of a supermarket shelf by several inches. Because of the constantly changing nature and repositioning of supermarket merchandise, it is imperative that shelf extenders be not only easily removable from a shelf surface but also flexible in being accepted by a variety of shelves and whose position can be altered without necessarily removing connecting means attaching the shelf extender to its supporting shelf structure.

U.S. Pat. No. 4,606,280 which issued on Aug. 19, 1986 teaches a one-piece extruded plastic shelf extender which has proven to be quite useful.

However, the shelf extender of the '280 patent possesses certain limitations which are inherent in its design and construction. Specifically, the shelf extender of the prior art is provided with outwardly extending lips from its bottom surface which are intended to be gripped by channel means located along the front surface of the shelf to be extended. As such, the shelf extender of the '280 patent is limited in its use in at least two important respects. Firstly, the prior art shelf extender can only be used in conjunction with shelving having a forward extending channel.

Secondly, although the shelf extender can be positioned by sliding it along the forward-facing channel of the supporting shelf, its extension from the supporting shelf cannot be varied thus providing significant limitations in its overall usefulness.

It is thus an object of the present invention to provide a shelf extender having a more universal application than those of the prior art.

It is yet a further object of the present invention to provide a shelf extender which is easily connected to a supporting shelf and yet which is capable of being repositioned on said shelf without removal of said connector means.

These and further objects will be more readily appreciated when considering the following disclosure and appended claims.

SUMMARY OF THE INVENTION

The present invention is directed to a shelf extender for attachment to a perf board shelf having a regular array of holes configured therein. The shelf extender is provided with a top surface of substantially rectangular dimension which is provided with substantially parallel front and rear edges and substantially parallel side edges, the side edges being substantially perpendicular to the front and rear edges. The front edge of the top surface is contiguous with a turned-up lip preventing inadvertent slippage of products from the front edge of the extender. The top surface is provided with at least one slot configured therein, the slot having a longitudinal axis substantially parallel to the front edge of the extender. Fastener means are provided for passing through the at least one slot in the shelf extender and holes in the shelf for retaining the shelf extender on the shelf.

DETAILED DESCRIPTION OF THE INVENTION

Figure 1:
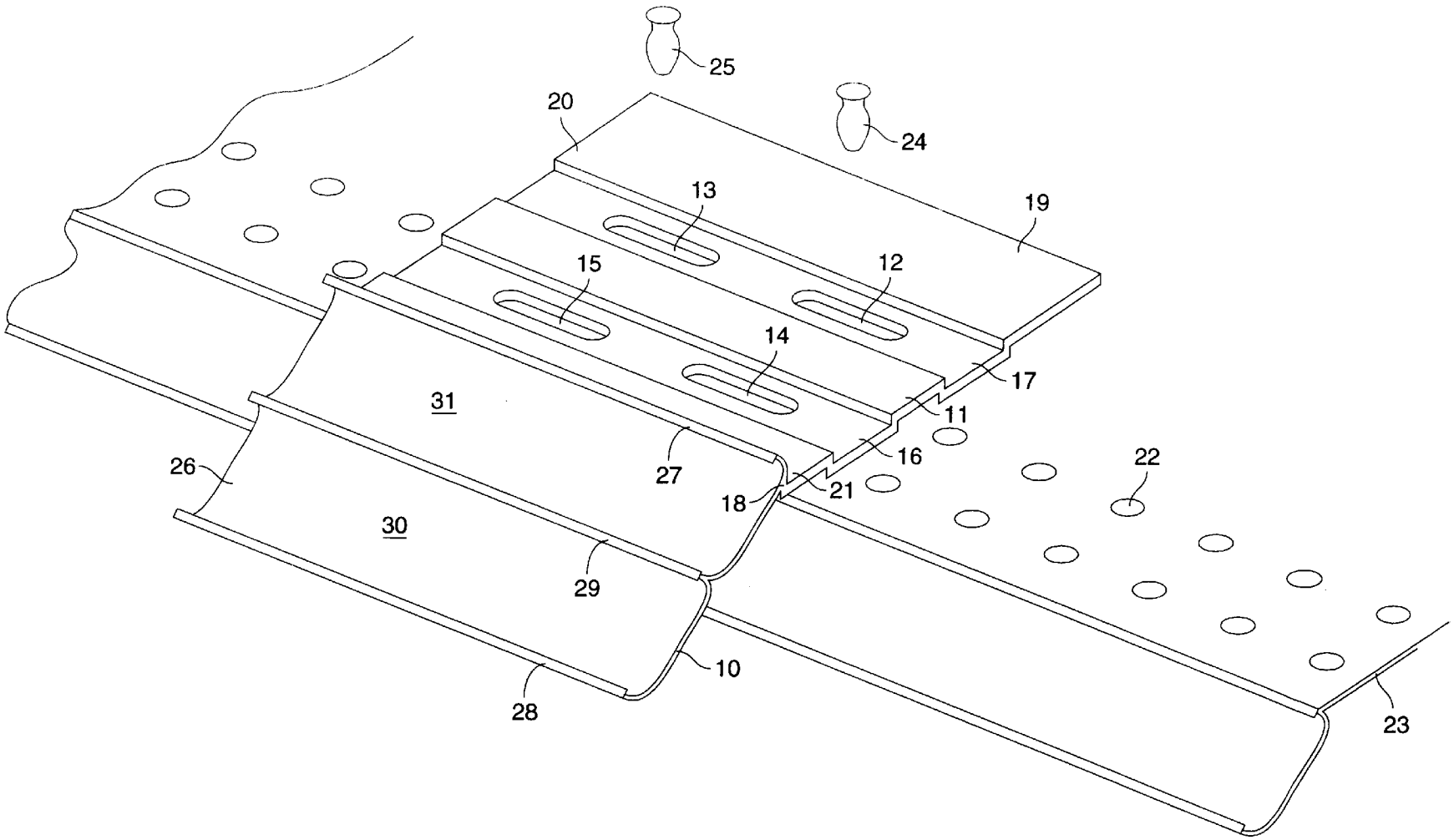
FIG. 1 is a perspective view of a shelf extender according to the present invention residing on a suitable shelf.

Turning first to FIG. 1, shelf extender 10 is generally preferably provided with a uniform cross-section enabling it to be extruded as a continuous piece of plastic although the extender can be molded as well. The shelf extender of the present invention is intended to reside on a typical perf-board shelf 23 containing an array of holes 22 generally arranged in a regular pattern where holes 22 are distanced typically on one-inch centers.

As an important feature, shelf extender 10 is provided with at least one slot 32 (FIG. 3) having an oval configuration and whose longitudinal axis is substantially parallel to edge 18 or up-turned lip 33. As preferred embodiments, as shown in FIG. 1, shelf extender 10 is provided with at least two slots 12 and 13 and, preferably, four slots 12, 13, 14 and 15 within top surface 11. Slots are generally of, once again, an oval configuration. When more than one are employed, they are positioned as being substantially parallel to one another while each pair of slots is equidistant from front edge 18. Fastener means such as plastic rivets 24 and 25 are caused to pass through appropriate slot(s) to removably secure top surface 11 to shelf 23 as shown in cross-section in FIG. 2.

Providing suitable slot(s) within top surface 11 results in a number of advantages over the prior art such as embodied in U.S. Pat. No. 4,606,280. Specifically, by providing one or more slots and plastic rivets 24 and 25, shelf extender 10 is capable of being securely attached to shelf 23 along any series of holes 22. As such, the present invention does not require any particular hole spacing or the use of any shelf lip to secure shelf extender 10 thereto. Also, once shelf extender 10 is secured to shelf 23, the shelf extender can slide over shelf 23 to the extent that slot(s) provide for the sliding of plastic rivets 24 and 25 therein.

As noted above, a second set of slots 14 and 15 can also be provided to add increased flexibility of the present invention. The choice of a particular pair of slots to receive suitable attachment means would depend upon a number of variables, for example, how far the shelf extender is intended to extend beyond the front edge of the shelf and where the perf holes of any particular shelf happen to be located. In either case, the present invention provides for at least one slot 42 and more preferably for at least a pair of slots 12 and 13 and/or 14 and 15 for receiving at least a pair of attachment means such as plastic rivets 24 and 25. By providing attachment means in pairs, shelf extender 10 is provided with suitable resistance against misalignment in the event that the present invention is inadvertently bumped by a consumer.

It is noted that top surface 11 is of a substantially rectangular dimension, the top surface being provided with substantially parallel front and rear edges 18 and 19 and substantially parallel side edges 20 and 21, the side edges being substantially perpendicular to the front and rear edges. Front edge 18 is contiguous with upturned lip 33 (FIG. 3) which acts to prevent product placed on the shelf extender from inadvertently sliding forward and off of the shelf surface. As a further embodiment, front edge 18 is contiguous with a channel 26 having inwardly turned lips 27 and 28 for accepting pricing and identifying information of product intended to be displayed on shelf extender 10.

In referring to the appended figures, portions 16 and 17 of top surface 11 in the vicinity of slots 12–13 and 14–15 are recessed to prevent fastener means such as plastic rivets 24 and 25 from extending above the top surface. Raised portion 35 has yet a further utility. It is noted that most preexisting display shelves have channel means 36 (FIG. 2) for product and price display of goods residing on the shelf surface. These channel means 36 are generally configured to rise above the plane of the surrounding shelf. As such, to clear channel means 36, raised portion 35 of the shelf extender is created.

Figure 2:
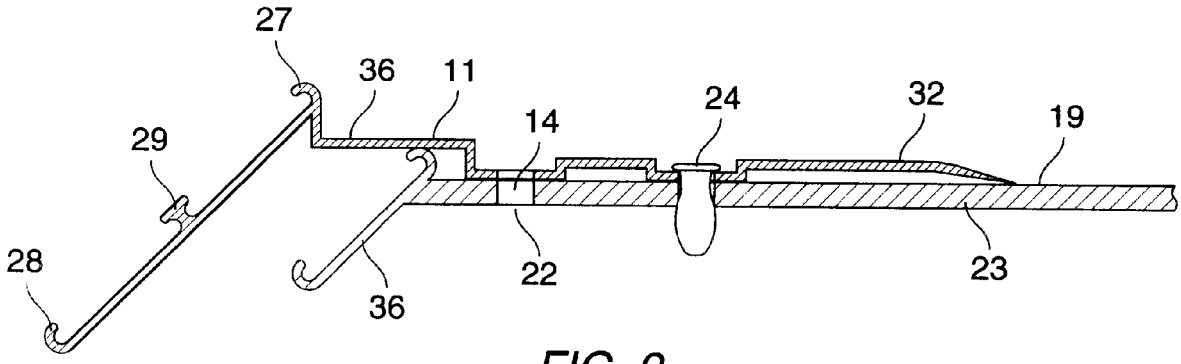
FIG. 2 is a side cross-sectional view of the shelf extender and supporting shelf of FIG. 1 with connector means suitably positioned therein.
Figure 3:
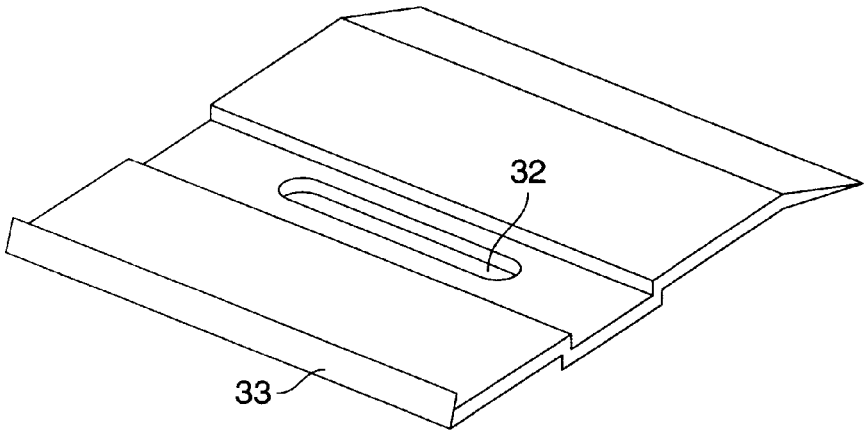
FIG. 3 is a further perspective view of a shelf extender according to the present invention showing additional embodiments thereof.

As yet a further preferred embodiment, it is seen by viewing FIGS. 1 and 2 that a portion of channel 26 extends vertically above top surface 11 at forward edge 18. This creates a lip which in turn prevents the inadvertent sliding of product residing on top surface 11 from sliding from its front edge.

As noted previously, channel 26 is provided with top and bottom inwardly turned lips 27 and 28 which are substantially parallel to one another. As a preferred embodiment, a further ridge 29 is located equidistant between lips 27 and 28 bifurcating channel 26 into two channels of substantially equal size. As such, product identifying and pricing information can be carried within bifurcated channels 31 and 32 which enhances the flexibility of the present sign extender. Alternatively, single large product identifying strips can be placed between lips 27 and 28 while ridge 29 provides a backing to the center of these identifying strips to maintain their conformity within channel 26.

The present invention further contemplates as a preferred embodiment, the sloping or beveling of rear edge 19 as shown as element 32 in FIG. 2. This creates a ramp at the rear edge of shelf extender 10 for facilitating the sliding of product from shelf 23 to the top surface of the shelf extender.

I claim:

1. A horizontally extending shelf extender and horizontally extending perf-board shelf, said perf-board shelf having a regular array of holes configured in its horizontally extending surface and perf-board channel comprising top and bottom inwardly turned lips along an edge thereof, said shelf extender having a top surface, a front edge of said top surface being contiguous with a shelf channel of said shelf extender having inwardly turned lips, said shelf extender further being characterized as having at least one slot configured within said top surface for receiving fastener means for passing through said slot within said top surface and a hole in said perf-board shelf for retaining said shelf extender on said perf-board such that said top surface is oriented horizontally upon said perf-board shelf and said top surface being further characterized as having a portion thereof proximate said front edge vertically rise above said perf-board channel such that said shelf channel is located vertically above and horizontally forward of said perf-board channel when said top surface of said shelf extender has been retained upon said perf board shelf.

2. The horizontally extending shelf extender and horizontally extending perf-board shelf of claim 1 wherein a portion of said top surface proximate said slot is recessed to prevent said fastener means from extending above the top surface.

3. The horizontally extending shelf extender and horizontally extending perf-board shelf of claim 1 wherein said channel of said shelf extender comprises top and bottom inwardly turned lips, said lips being substantially parallel to one another and a ridge located equidistant between said lips, said ridge bifurcating said channel into two channels of substantially equal size.

4. The horizontally extending shelf extender and horizontally extending perf-board shelf of claim 1 wherein said shelf extender is provided with a rear edge, said rear edge is provided with a sloping profile to provide a ramp for facilitating the sliding of product from said shelf to said top surface of said shelf extender.

5. The horizontally extending shelf extender and horizontally extending perf-board shelf of claim 1 wherein said shelf extender is of unitary construction formed of a contiguous piece of extrudable material.

* * * * *